US005379741A

United States Patent [19]

Matysiewicz et al.

[11] Patent Number: 5,379,741

[45] Date of Patent: Jan. 10, 1995

[54] INTERNAL COMBUSTION ENGINE FUEL SYSTEM WITH INVERSE MODEL CONTROL OF FUEL SUPPLY PUMP

[75] Inventors: Edwin J. Matysiewicz, Farmington Hills; Charles I. Rackmil, Ann Arbor; James C. Smith, Farmington Hills, all of Mich.

[73] Assignee: Ford Motor Company, Dearborn, Mich.

[21] Appl. No.: 173,030

[22] Filed: Dec. 27, 1993

[51] Int. Cl.[6] ..... F02M 37/04

[52] U.S. Cl. ..... 123/497

[58] Field of Search ..... 123/497, 499, 381, 463, 123/464

[56] References Cited

U.S. PATENT DOCUMENTS

| | | | |
|---|---|---|---|
| 3,967,598 | 7/1976 | Rachel | 123/497 |
| 4,024,864 | 5/1977 | Davies et al. . | |
| 4,248,194 | 2/1981 | Drutchas et al. | 123/357 |
| 4,577,604 | 3/1986 | Hara et al. | 123/497 |
| 4,756,291 | 7/1988 | Cummings et al. | 123/497 |
| 4,920,942 | 5/1990 | Fujimori et al. | 123/497 |
| 4,926,829 | 5/1990 | Tuckey | 123/497 |
| 4,940,034 | 7/1990 | Heim et al. | 123/497 |
| 4,982,331 | 1/1991 | Miyazaki | 123/497 |
| 5,044,344 | 9/1991 | Tuckey et al. | 123/497 |
| 5,092,302 | 3/1992 | Mohan | 123/497 |
| 5,133,323 | 7/1992 | Treusch | 123/497 |
| 5,237,975 | 8/1993 | Betki et al. | 123/456 |
| 5,293,299 | 3/1994 | Iwabuchi et al. | 123/497 |

*Primary Examiner*—Andrew M. Dolinar
*Assistant Examiner*—Thomas N. Moulis
*Attorney, Agent, or Firm*—J. R. Drouillard; R. L. May

[57] ABSTRACT

A feedforward control system for an electrically operated fuel injection pump for an internal combustion engine includes a controller for determining required fuel pressure and flow rate to be delivered by the pump and for using the determined fuel pressure and flow rate to determine a variable operating voltage for the pump. The variable operating voltage may be delivered as a pulsewidth modulated voltage, with the system being used to operate the pump in an open loop fashion.

4 Claims, 1 Drawing Sheet

INTERNAL COMBUSTION ENGINE FUEL SYSTEM WITH INVERSE MODEL CONTROL OF FUEL SUPPLY PUMP

BACKGROUND OF THE INVENTION

This invention relates to a system and method for operating an electrically powered pump used for supplying fuel to electronically controlled fuel injectors in an internal combustion engine.

DESCRIPTION OF THE PRIOR ART

Conventional electronic fuel injection systems use an electrically powered pump which is controlled at a constant speed to supply fuel to the fuel injectors. The pump pushes much more fuel than is usually needed from the fuel storage tank to the injectors, and as a consequence, most of the fuel is bypassed. Other known systems sense fuel system pressure and input this signal to an electronic engine controller, which then controls the speed at which the pump is operated. The system of the present invention, however, uses an inverse fuel pump model to offload fuel pump control from the engine controller's feedback control system; instead a feedforward system is employed to control the pump. The present system is said to be an inverse model because the inputs are fuel pressure and fuel flow rate and the output is a duty cycle or other type of variable operating voltage for the fuel pump. By offloading work from the feedback portion of the electronic engine controller, better control may be achieved without excessively high feedback gains. Such high gains are generally associated with system instability and unwanted oscillatory response. The present system avoids such disadvantages.

SUMMARY OF THE INVENTION

A feedforward control system for an electrically operated fuel injection pump for an internal combustion engine includes means for determining the required fuel pressure and flow rate to be delivered by the pump, means for using the determined fuel pressure and flow rate to determine a variable operating voltage for the pump, and means for supplying the determined variable operating voltage to the pump. The means for determining voltage may comprise means for calculating a pulsewidth modulated voltage to be applied to the pump. The calculated pulsewidth may be adjusted to correct for variations in the voltage available for operating the pump and variations in the temperature of the fuel being pumped. If desired, the actual fuel pressure from the pump may be compared with desired pressure and the results of the comparison used for adjusting the variable operating voltage supplied to the pump.

According to another aspect of the present invention, means for using the determined fuel pressure and flow rate to determine a variable operating voltage for the pump may comprise a lookup table having fuel pressure and flow rate as independent variables and pump supply voltage as a dependent variable.

Alternatively, a means for using determined fuel pressure and flow rate to determine the variable operating voltage for the pump may comprise an arithmetic processor using fuel pressure and flow as independent variables and having pump operating voltage as its output. The arithmetic processor may also utilize pump supply voltage and fuel temperatures as independent variables. As another alternative, the arithmetic processor may incorporate a set of linear differential equations having fuel pressure, fuel flow rate, pump supply voltage, and fuel temperature as independent variables, with the equations yielding a pump voltage value required to maintain the desired fuel pressure.

DETAILED OF THE PREFERRED EMBODIMENTS

Figure 1:
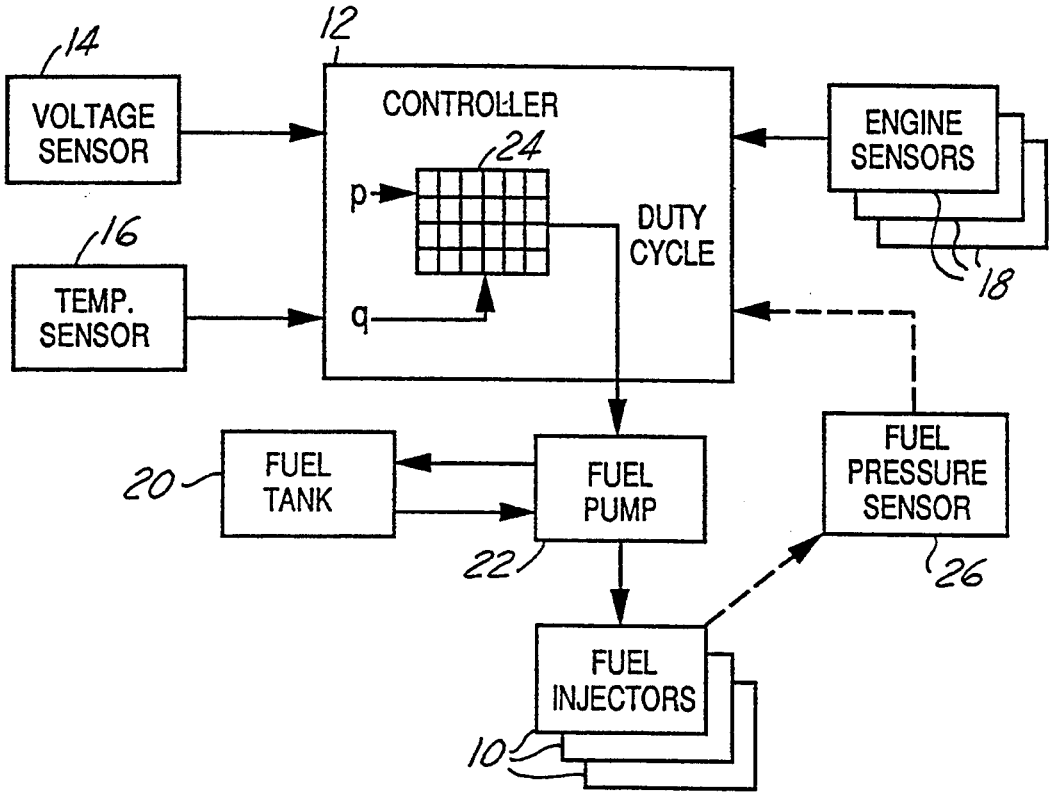
FIG. 1 is a schematic representation of a fuel injection system according to the present invention.

As shown in FIG. 1, a fuel injection system includes a plurality of fuel injectors 10, which are supplied by fuel via fuel pump 22. Fuel pump 22 receives fuel from fuel tank 20. The signals required to operate fuel pump 22 are output by electronic engine controller 12. The electronic engine controller is a microprocessor controller of the type known to those skilled in the art of engine controls and used to operate such functions as fuel injector pulsewidth, engine spark timimg, EGR control, evaporative emissions control purging, and transmission gear selection.

Electronic controller 12 receives inputs from voltage sensor 14, which determines battery voltage or pump supply voltage available to fuel pump 22, as well as temperature sensor 16 which measures the temperature of the fuel being pumped by fuel pump 22. A variety of engine sensors 18 provides information to electronic engine controller 12 for variables such as engine speed, engine load, engine coolant temperature, EGR rate, air/fuel ratio, mass air flow, and other operating parameters. From these parameters, a desired fuel pump pressure, p, and flow rate, q, are selected according to any of the known algorithms for determining desired fuel pump pressure and flow. The desired values of p and q are entered into a lookup table 24, which is contained within controller 12, and the value of duty cycle is read out. If desired, the sensed values for pump supply voltage and fuel temperature may be used to modify the duty cycle extracted from Table 24. This may be done by performing a simple comparison of the sensed voltage and temperature with reference values, or two dimensions could be added to look-up Table 24 to make a four-dimensional table so as to directly account for the sensed values of voltage and temperature. In the event that it is desired to run a system having an inverse model feedforward feature according to the present invention with feedback of fuel pressure, fuel pressure sensor 26 may be employed to sense the value of the pressure at the injectors, or across the injectors, and to feed this value back to controller 12 so that the controller will be able to alter the duty cycle accordingly. Such a system, including feedback of fuel pressure, will help to offload the feedback portion of the engine controller by providing the initial pump signal in a feedforward or open loop manner.

Figure 2:
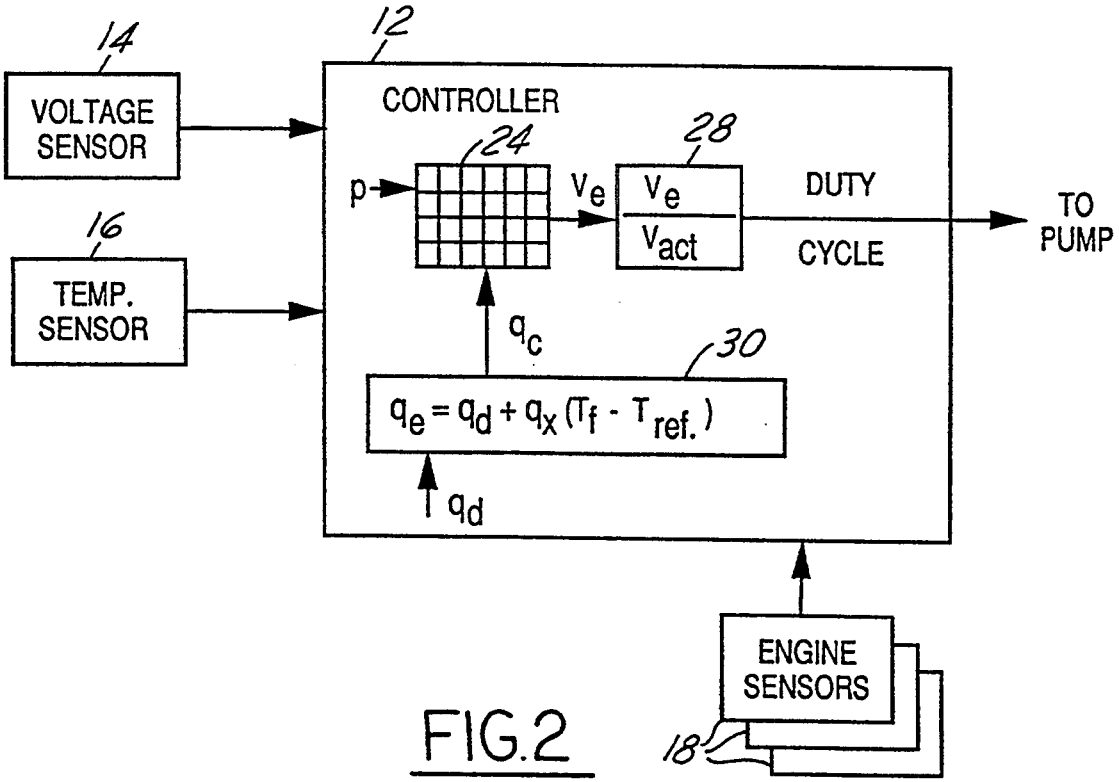
FIG. 2 is a schematic representation of a second embodiment of a fuel injection system according to the present invention.

FIG. 2 illustrates a second embodiment of the present invention in which the output of voltage sensor 14 and temperature sensor 16 are used to correct the duty cycle extracted from Table 24 in a manner which varies from that previously discussed. As shown in box 28, the sensed actual voltage, $V_{act}$, is used to correct the value of $v_e$, which is the output extracted from lookup table 24. Effectively, $v_e$, which is the desired effective voltage, at the pumps, is used in the ratio $V_e/V_{act}$, and this ratio (which is clipped between zero and one) is the duty cycle which is supplied to the fuel pump. As one example of the present embodiment, if $v_e$ is 11 volts and $V_{act}$ is 10 volts, the ratio of $v_e/v_{act}$ will be 1.1. This value is clipped to 1 and the duty cycle to the pump is 100%. If, on the other hand, $v_e$ is 8 volts and $v_{act}$ is 10 volts, the ratio of $v_e/v_{act}$ will be 0.8 and the duty cycle to the pump is 80%.

Box 30 of FIG. 2 illustrates a correction factor to account for changes in fuel temperature. A corrected flow, $q_c$, is the output of box 30, with a desired flow, $q_d$, being input along with $T_f$, or sensed fuel temperature, as furnished by temperature sensor 16. Corrected flow is given by the equation:

$$q_c = q_d + q_x x (T_f - T_{ref})$$

where:

$q_d$=desired flow;

$q_x$=a constant; and $T_{ref}$=a reference temperature.

As an alternative to the use of a lookup table for determining the effective voltage or the duty cycle needed for the fuel pump in a system according to the present invention, the means for determining a variable operating voltage for the pump from the determined fuel pressure and flow rate may include an arithmetic processor using fuel pressure and flow rate as independent variables as well as at least fuel temperature and pump supply voltage. This could be achieved by using an equation having the following form:

$$\text{Duty Cycle} = \ldots + a_{-4}p^{-2}q^{-2} + a_{-3}p^{-1}q^{-2} + a_{-2}p^{-2}q^{-1} + a_{-1}p^{-1}q^{-1} + a_1pq + a_2p^2q + a_3pq^2 + a_4p_2q_2 + \ldots$$

$$\ldots + b_{-2}p^{-2} + b_{-1}p^{-1} + b_1p^1 + b_2p^2 + \ldots$$

$$\ldots + c_{-2}q^{-2} + c_{-1}q^{-1} + c_0 + c_1q^1 + c_2q^2 + \ldots$$

where:

$a_n = f_n(V_{act}, T_{inlet})$, etc.

$b_n = f_n(V_{act}, T_{inlet})$, etc.

$c_n = f_n(V_{act}, T_{inlet})$, etc.

p=pumping system output pressure q=pumping system output flow $V_{act} = V_{batt}$-voltage drop to and within pump driver=high side switching voltage available at the pump $T_{inlet}$=pump inlet temperature A second type of arithmetic processor could incorporate a set of linear differential equations having fuel pressure, fuel flow rate, pump supply voltage and fuel temperature as independent variables. These equations will yield a pump voltage value required to maintain the desired fuel pressure. The linear differential equations could be expressed as follows:

$$x(t) = A(V_{act}, T_{inlet})x(t) + B(V_{act}, T_{inlet})u(t)$$

$$y(t) = Cx(t) + Du(t)$$

where:

t=time x(t)=dynamic states of the inverse model x(t)=derivative of x(t) with respect to time u(t)=(q p), y(t)=required pump command to maintain injector pressure $V_{act}$=the high side of the duty cycle $T_{inlet}$=pump inlet temperature.

q=pump output flow rate p=pump output pressure

A, B, C, and D=matrices of coefficients defining the model's dynamics

The dynamic form of the inverse model as expressed by the linear differential equations above is desirable because it may be employed to account for dynamic or transient pump data across a range of values of pump supply voltage fuel temperature and pressure and flow rate. Standard system identification techniques such as recursive least squares may be used to fit dynamic flow data to the inverse model's A, B, C and D matrices. In general the present system may be implemented by collecting pumping test data under various conditions accounting for a range of values of supply voltage, fuel temperature, fuel pressure and flow rate.

We claim:

1. A feedforward control system for an electrically operated fuel injection pump for an internal combustion engine, comprising:

means for determining the required fuel pressure and flow rate to be delivered by the pump;

voltage determination means for using the determined fuel pressure and flow rate to determine a variable operating voltage for the pump; and means for supplying the determined variable operating voltage to the pump with said voltage determination means comprising an arithmetic processor using fuel pressure, fuel flow rate, pump supply voltage, and fuel temperature as independent variables, and having pump operating voltage as its output.

2. A feedforward system according to claim 1, wherein said arithmetic processor incorporates a set of linear differential equations having fuel pressure and flow rate as well as pump supply voltage and fuel temperature as independent variables, with said equations yielding a pump voltage value required to maintain the desired fuel pressure.

3. A fuel injection apparatus for an internal combustion engine, comprising:

a pump for transferring fuel from a fuel storage tank to one or more fuel injectors mounted within the engine, with said pump being powered by an electrical supply means having a supply voltage available to the pump;

means for determining the required fuel pressure and flow rate to be delivered by the pump to the injectors;

control means for using the determined fuel pressure and flow rate to determine an effective operating voltage for the pump and for determining an appropriate duty cycle to apply to said supply voltage so as to produce said effective operating voltage, with said means for determining required fuel flow rate comprising means for determining a base fuel flow and means for adjusting the base fuel flow value as a function of the fuel supply temperature; and means for supplying the determined duty cycle voltage to the pump.

4. A fuel injection apparatus according to claim 3, wherein said means for determining an effective operating voltage for the pump comprises a lookup table having required fuel pressure and flow rate as inputs and pump supply voltage as an output, with the required flow rate being adjusted as a function of the fuel supply temperature.

* * * * *